US008608137B2

(12) United States Patent
Suzuki

(10) Patent No.: US 8,608,137 B2
(45) Date of Patent: Dec. 17, 2013

(54) ROTARY CARBURETOR

(75) Inventor: Daisuke Suzuki, Morioka (JP)

(73) Assignee: Zama Japan Kabushiki Kaisha, Iwate (JP)

( * ) Notice: Subject to any disclaimer, the term of this patent is extended or adjusted under 35 U.S.C. 154(b) by 255 days.

(21) Appl. No.: 13/189,279

(22) Filed: Jul. 22, 2011

(65) Prior Publication Data

US 2012/0043675 A1 Feb. 23, 2012

(30) Foreign Application Priority Data

Aug. 18, 2010 (JP) ..... 2010-182775

(51) Int. Cl.
*F02M 9/08* (2006.01)

(52) U.S. Cl.
USPC ..... 261/44.6; 261/44.8

(58) Field of Classification Search
USPC ..... 261/44.1, 44.6, 44.8
See application file for complete search history.

(56) References Cited

U.S. PATENT DOCUMENTS 1,120,845 A * 12/1914 Parkin ..... 261/44.8
4,481,153 A * 11/1984 Kobayashi et al. ..... 261/44.2
6,231,033 B1 * 5/2001 Araki ..... 261/44.8
6,394,425 B1 * 5/2002 Nagata ..... 261/44.8
2004/0130040 A1 * 7/2004 Araki ..... 261/34.2
2005/0104235 A1 * 5/2005 Sasaki et al. ..... 261/44.6
2006/0151893 A1 * 7/2006 Horikawa et al. ..... 261/44.6

FOREIGN PATENT DOCUMENTS

JP 58-92447 6/1983
JP 58-092447 6/1983
JP 3-50367 A * 3/1991 ..... 261/44.8
JP 06-129303 5/1994

* cited by examiner

*Primary Examiner* — Richard L Chiesa
(74) *Attorney, Agent, or Firm* — Kenneth S. Roberts; One LLP

(57) ABSTRACT

A carburetor including a columnar throttle valve, a fuel nozzle, a metering needle inserted into the fuel nozzle and a cam mechanism caused to rotate in accordance with the throttle operation, whereby the throttle valve is moved by the cam mechanism in the direction of the valve stem while rotating to adjust the air flow rate and the fuel flow rate. The cam mechanism has a cam groove provided with a cam surface so as to gradually deepen in the direction of rotation in a designated range on the external peripheral side of the bottom surface of the throttle valve, and a support pin for supporting the throttle valve from the bottom surface, wherein the support pin being disposed between the cam surface and the bottom surface of the columnar throttle valve chamber rotatably provided with the throttle valve.

10 Claims, 2 Drawing Sheets

ROTARY CARBURETOR

FIELD OF THE INVENTION

The present invention relates to a rotary carburetor provided with a cam mechanism for causing the throttle valve to move in the direction of the valve stem.

DESCRIPTION OF THE RELATED ART

Rotary carburetors (carburetors with rotary throttle valves) provided with a cam mechanism for causing the throttle valve to move in the direction of the valve stem are becoming widespread as devices for supplying vaporized fuel to the engines of portable machinery for use in farming and forestry and in compact vehicles, among other applications. In this type of rotary carburetor, a columnar throttle valve having a throttle valve opening and a metering needle is disposed orthogonally to the intake passage of the main section of the carburetor. The throttle valve is caused to move in the direction of the valve stem while rotating in accordance with the accelerator operation, whereby the air flow rate is controlled while the degree to which the throttle valve opening overlaps with the intake passage is varied, and the depth to which the metering needle is inserted into the fuel nozzle is varied to control the fuel flow rate.

The cam mechanism is used as a means for causing the throttle valve to move in the direction of the valve stem. An example of the cam mechanism is described in Japanese Utility Model Application Publication No. JP 58-92447. As shown in the partial longitudinal sectional view of FIG. 5(A), a carburetor is known wherein a sloped end cam 58 is provided to the surface of a cover 56 for sealing off a throttle valve chamber 55 in which a throttle valve is mounted, and a follower pin 59 is provided protruding from the lower surface of a throttle lever 57.

Another example is described in Japanese Patent Application Publication No. JP-A 6-129303. As shown in the partial longitudinal sectional view of FIG. 5(B), a carburetor is known wherein a follower pin 60 is provided protruding from the bottom surface of a throttle valve 52, and an end cam 61 is provided protruding from the bottom surface of the throttle valve opening 55. The carburetor may also have a layout in which these components are reversed.

Carburetors provided with a cam mechanism on the outside of the main section, as in the first example above, have an advantage over carburetors provided with an internal cam mechanism in that the cam mechanism can be installed without enlarging the main section of the carburetor. However, exposing the cam mechanism on the outside makes it easier for this part to collect dust and waste, causing malfunctions and destabilizing the fuel flow rate.

On the other hand, carburetors provided with a cam mechanism inside the main section, as in the second example above, do not have the trouble of collecting dust and other materials from the outside. However, because space must be reserved in order to install the cam mechanism inside the main section of the carburetor, the main section of the carburetor tends to be larger, and, in particular, the main section of the carburetor must be enlarged even further, thus rendering this approach disadvantageous in the case where large throttle valves are used in high-exhaust engines.

SUMMARY OF THE INVENTION

The present invention is intended to solve problems such as those described above, and is aimed at allowing a cam mechanism for causing the throttle valve to move in the direction of the valve stem to be disposed in a rotary carburetor without the accompanying enlargement of the main section of the carburetor.

In view of the above, the present invention provides a rotary carburetor comprising a columnar throttle valve disposed orthogonally to the intake passage of the main section of the carburetor and provided with a throttle through-hole and a metering needle; a fuel nozzle disposed on the center axis line of the throttle valve, the metering needle being inserted into the fuel nozzle; and a cam mechanism for causing the throttle valve to move in the direction of a valve stem extending from the center of the top surface of the throttle valve and being caused to rotate in accordance with the throttle operation, whereby the throttle valve is moved by the cam mechanism in the direction of the valve stem while rotating integrally with the valve stem to adjust the air flow rate and the fuel flow rate, wherein the cam mechanism has a cam groove provided with a cam surface so as to gradually deepen in the direction of rotation in a designated range on the external peripheral side of the bottom surface of the throttle valve, and a support pin for supporting the throttle valve from the bottom surface, the support pin being disposed between the cam surface of the throttle valve and the bottom surface of the columnar throttle valve chamber rotatably provided with the throttle valve.

In conventional rotary carburetors with a cam mechanism disposed on the inside of the main section of the carburetor, the part that constitutes the cam surface is provided protruding from the bottom surface of the throttle valve or from the bottom surface of the throttle valve chamber, and the width of the support pin adds to the protrusion, whereby the length of the throttle valve chamber is increased in the direction of the valve stem, causing the main section of the carburetor to be enlarged. In contrast, the cam surface of the cam mechanism in the present invention is formed by removing material from the bottom surface of the throttle valve to form a recess, making it possible to minimize the enlargement of the main section of the carburetor because the cam surface does not protrude out and the support pin fits inside the cam groove.

In addition, with the rotary carburetor, accurate adjustment of the air flow rate and the fuel flow rate can be facilitated using a simple operation by configuring the cam mechanism so that the throttle valve is in the uppermost position when the throttle is fully open, and the throttle valve is in the lowermost position when the throttle is fully closed. In this case, the enlargement of the main section of the carburetor can be completely avoided by adopting an arrangement in which the cam mechanism brings the bottom surface of the throttle valve in substantially close contact with the bottom surface of the throttle valve chamber when the throttle is fully closed.

Furthermore, the rotary carburetor described above is made comparatively easy to assemble by adopting an approach in which the cam groove is formed at a designated width from the external peripheral edge of the bottom surface of the throttle valve in the direction of the center axis, and the support pin of the cam mechanism is inserted laterally in the direction orthogonal to the center axis line of the throttle valve.

Further still, in the rotary carburetor described above, wear in the section where the support pin and the throttle valve come into contact with each other can be readily minimized by adopting an arrangement in which the section of the support pin in abutment with the cam surface serves as a support roller that rotates in concert with the rotation of the throttle valve.

According to the present invention, in which the cam surface of the cam mechanism is formed with a cam groove provided at the bottom surface of the throttle valve, the cam mechanism that causes the throttle valve to move in the direction of the valve stem can be provided without the accompanying enlargement of the main section of the carburetor.

DESCRIPTION OF THE PREFERRED EMBODIMENTS

Embodiments of the present invention are described below with reference to the accompanying drawings.

Figure 1:
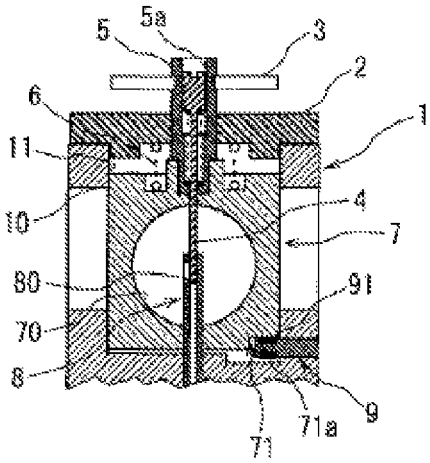
FIG. 1 is a partial longitudinal sectional view of a rotary carburetor according to an embodiment of the present invention.

FIG. 1 is a partial longitudinal sectional view primarily showing the rotary carburetor according to the present embodiment in the section containing an intake passage 10. In the carburetor, a columnar throttle valve 7 in which a valve stem 5 having a throttle lever 3 is connected to the base end is disposed inside a throttle valve chamber 11 formed in a columnar shape, orthogonally to the intake passage 10 of the main section 1 of the carburetor. The throttle valve can rotate about the center axis line of the throttle valve chamber 11.

A throttle valve opening 70 runs through the throttle valve 7 from the side of the throttle valve orthogonally to the center axis line; the distal end of a metering needle 4 disposed in a throttle through-hole a running through the valve stem 5 protrudes into the throttle valve opening 70 and enters a fuel nozzle 8, which extends from the bottom surface of a throttle valve chamber 11, runs through the bottom surface of the throttle valve 7, and extends to the center position of the throttle valve opening 70; and the degree of opening of a fuel port 80 formed in the side surface on the distal end of the fuel nozzle 8 can be varied by varying the insertion depth of the needle to change the fuel flow rate.

A valve spring 6 is interposed between the side surface of the base end of the throttle valve 7 and the inner surface of a cover 2 for closing off the open part of the throttle valve chamber 11, and rotating the throttle lever 3 of the throttle valve allows the throttle valve 7 to move in the direction of the valve stem via the action of a cam mechanism (described in detail below) while rotating inside the throttle valve chamber 11, and the air flow rate and the fuel flow rate to be adjusted.

Figure 5:
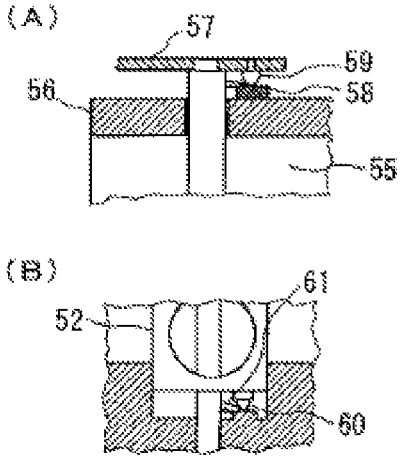
FIG. 5(A) is a partial longitudinal sectional view showing a conventional example, and (B) is a partial longitudinal sectional view showing another conventional example.

Specifically, in conventional practice, the end cam provided with a cam surface comes into contact with the support pin while protruding from the bottom surface of the throttle valve or the bottom surface of the throttle valve chamber in cases in which the cam mechanism is disposed inside the main section of the carburetor, as shown in FIG. 5(B). The resulting problem is that the length of the throttle valve chamber increases in the direction of the valve stem in a commensurate manner, and the size of the main section of the carburetor is enlarged.

In contrast, the cam mechanism in the rotary carburetor of the present invention is configured by providing a cam groove 71 in which a sloped cam surface 71*a* (bottom surface) is formed so as to become gradually deeper in the direction of rotation of the throttle valve 7 in a designated range on the external peripheral side of the bottom surface of the throttle valve 7, and by using this in combination with a columnar support pin 9 for supporting the throttle valve 7 from the bottom surface between the cam surface 71*a* of the throttle valve 7 and the bottom surface of the columnar throttle valve chamber 11 in which the throttle valve 7 is rotatably installed.

The cam groove 71 is formed at a designated width from the external peripheral edge of the bottom surface of the throttle valve 7 in the direction of the center axis; the columnar support pin 9 is laterally inserted in the direction orthogonal to the center axis line of the throttle valve 7; and the section in abutment with the cam surface 71*a* serves as a support roller 91 that rotates in concert with the rotation of the throttle valve 7, making it possible to minimize wear in the section where the support pin 9 and the throttle valve 7 come into contact with each other.

FIG. 1 shows the throttle of the rotary carburetor in a fully closed state. The throttle valve 7 is at the lowermost position and is supported in a state in which the support pin 9 is in contact with the section containing the cam surface 71*a*, which is the deepest section of the cam groove 71 formed at the bottom surface of the valve. The bottom surface of the throttle valve 7 is positioned so as to be in substantially close contact with the bottom surface of the throttle valve chamber 11.

Figure 2:
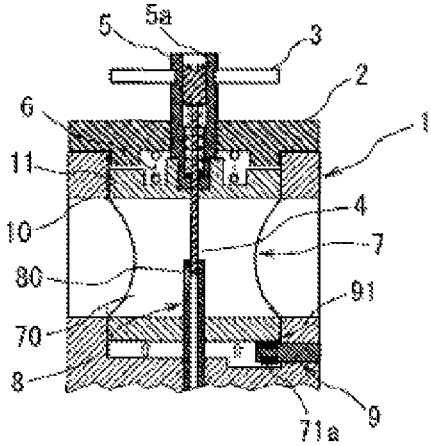
FIG. 2 is a partial longitudinal sectional view of a case in which the throttle valve of the rotary carburetor in FIG. 1 is rotated and brought to a fully open state.
Figure 3:
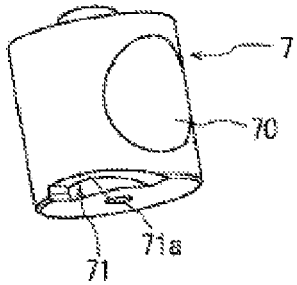
FIG. 3 is a perspective view of the throttle valve of the rotary carburetor in FIG. 1.
Figure 4:
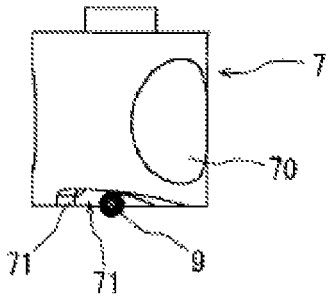
FIG. 4 is a front view showing the configuration of the throttle valve of FIG. 3 and the cam mechanism based on the support pin.

The fully open state of the throttle shown in FIG. 2 is achieved by rotating the throttle lever 3 and the throttle valve 7. In this case, rotating the throttle valve 7 from the state shown in FIG. 1 causes the throttle valve 7 to move upward in the direction of the arrows while the valve spring 6 is compressed in accordance with a reduction in the depth of the position (which is essentially the position of the bottom surface) in which the support pin 9 is in contact with the sloped cam surface 71*a*. The internal peripheral surface of the throttle valve opening 70 lines up with the internal peripheral surface of the intake passage 10, the metering needle 4 moves upward, and the fuel port 80 of the fuel nozzle 8 is brought to a fully open state.

Rotating the throttle lever 3 in this manner causes the throttle valve 7 to move in the direction of the valve stem in concert with the rotation of the throttle valve 7 inside the throttle valve chamber 11 by the cam mechanism, and the fuel flow rate can therefore be adjusted at the same time as the air intake rate is adjusted. In this case, the throttle valve 7 is in the uppermost position when the throttle is fully open, and the throttle valve 7 is in the lowermost position when the throttle is fully closed. Accurate adjustment of the air flow rate and the fuel flow rate by a simple operation is therefore facilitated.

The cam mechanism for causing the throttle valve 7 to move in the direction of the valve stem also has a support pin 9 provided between the cam surface 71*a* based on the cam groove 71 formed in the bottom surface of the throttle valve 7, and the bottom surface of the throttle valve chamber 11 so as to be in contact with the cam surface, whereby the length of the throttle valve chamber 11 in the direction of the valve stem can be prevented from increasing, and the enlargement of the main section 1 of the carburetor can be minimized.

The cam mechanism can be assembled relatively easily because the mechanism is configured by laterally inserting the support pin 9 in the direction orthogonal to the center axis line of the throttle valve 7, and inserting the throttle valve 7 from above. Furthermore, the wear of the contacting sections can be minimized because the support pin 9 supports the throttle valve 7 in a state where the support roller 91 on the distal side is in contact with the cam surface 71*a*.

As described above, the rotary carburetor according to the present invention can accommodate a cam mechanism in which the throttle valve can be moved in the direction of the valve stem without the accompanying enlargement of the main section of the carburetor.

KEY

1 Main section of carburetor
2 Cover
3 Throttle lever
4 Metering needle
5 Valve stem
5*a* Throttle through-hole
6 Valve spring
7 Throttle valve
8 Fuel nozzle
9 Support pin
10 Intake passage
11 Throttle valve chamber
70 Throttle valve opening
71 Cam groove
71*a* Cam surface
80 Fuel port
91 Support roller

What is claimed is:

1. A rotary carburetor, comprising a columnar throttle valve disposed orthogonally to the intake passage of the main section of the carburetor and provided with a throttle through-hole and a metering needle;

a fuel nozzle disposed on the center axis line of the throttle valve, the metering needle being inserted into the fuel nozzle; and a cam mechanism for causing the throttle valve to move in the direction of a valve stem extending from the center of the top surface of the throttle valve and being caused to rotate in accordance with the throttle operation, whereby the throttle valve is moved by the cam mechanism in the direction of the valve stem while rotating integrally with the valve stem to adjust the air flow rate and the fuel flow rate;

wherein the cam mechanism includes:

a cam groove provided with a cam surface so as to gradually deepen in the direction of rotation in a designated range on the external peripheral side of the bottom surface of the throttle valve; and a support pin for supporting the throttle valve from the bottom surface, the support pin being disposed between the cam surface and the bottom surface of a columnar throttle valve chamber and rotatably provided with the throttle valve.

2. The rotary carburetor according to claim 1, wherein the cam mechanism is configured so that the throttle valve is in the uppermost position when the throttle is fully open, and the throttle valve is in the lowermost position when the throttle is fully closed.

3. The rotary carburetor according to claim 2, wherein the cam mechanism brings the bottom surface of the throttle valve in substantially close contact with the bottom surface of the throttle valve chamber when the throttle is fully closed.

4. The rotary carburetor according to claim 1 wherein the cam groove is formed at a designated width from the external peripheral edge of the bottom surface of the throttle valve in the direction of the center axis, and the support pin is inserted laterally in the direction orthogonal to the center axis line of the throttle valve.

5. The rotary carburetor according to claim 2 wherein the cam groove is formed at a designated width from the external peripheral edge of the bottom surface of the throttle valve in the direction of the center axis, and the support pin is inserted laterally in the direction orthogonal to the center axis line of the throttle valve.

6. The rotary carburetor according to claim 3 wherein the cam groove is formed at a designated width from the external peripheral edge of the bottom surface of the throttle valve in the direction of the center axis, and the support pin is inserted laterally in the direction orthogonal to the center axis line of the throttle valve.

7. The rotary carburetor according to claim 1 wherein the section of the support pin in abutment with the cam surface serves as a support roller that rotates in concert with the rotation of the throttle valve.

8. The rotary carburetor according to claim 2 wherein the section of the support pin in abutment with the cam surface serves as a support roller that rotates in concert with the rotation of the throttle valve.

9. The rotary carburetor according to claim 3 wherein the section of the support pin in abutment with the cam surface serves as a support roller that rotates in concert with the rotation of the throttle valve.

10. The rotary carburetor according to claim 4 wherein the section of the support pin in abutment with the cam surface serves as a support roller that rotates in concert with the rotation of the throttle valve.

* * * * *